United States Patent [19]

Kita

[11] Patent Number: 5,005,501

[45] Date of Patent: Apr. 9, 1991

[54] X-Y TABLE DEVICE IN AUTOMATIC SEWING MACHINE

[75] Inventor: Fujio Kita, Aichi, Japan

[73] Assignee: Mitsubishi Denki K.K., Tokyo, Japan

[21] Appl. No.: 409,368

[22] Filed: Sep. 19, 1989

[30] Foreign Application Priority Data

Sep. 27, 1988 [JP] Japan ..... 63-241381

[51] Int. Cl.[5] ..... D05B 21/00

[52] U.S. Cl. ..... 112/121.12; 112/103

[58] Field of Search ..... 112/121.15, 121.12, 112/103, 2, 311, 121.11

[56] References Cited

U.S. PATENT DOCUMENTS

| | | | |
|---|---|---|---|
| 3,072,081 | 1/1963 | Milligan et al. | 112/121.12 |
| 4,072,114 | 2/1978 | Sugiyama et al. | 112/121.12 |
| 4,114,545 | 9/1978 | Manabe et al. | 112/121.15 |
| 4,312,282 | 1/1982 | Dorosz et al. | 112/121.12 |
| 4,444,134 | 4/1984 | Maruyama et al. | 112/121.12 |
| 4,563,960 | 1/1986 | Albrecht | 112/121.15 |
| 4,602,578 | 7/1986 | Yokoe et al. | 112/121.15 |

*Primary Examiner*—Peter Nerbun

*Attorney, Agent, or Firm*—Sughrue, Mion, Zinn Macpeak & Seas

[57] ABSTRACT

In an automatic sewing machine in which a cloth retainer is moved according to a pattern stored in a memory to embroider the pattern, its X–Y table device includes: a guide rail, having a plurality of rail surfaces high in flatness, which is provided on a movable stand coupled to the cloth retainer, thus forming one unit high in rigidity together with a supporting piece; and a guide block engaged with the guide rail, whereby the device can be smoothly and stably moved, and it is less vibrated horizontally, and shows a high mechanical strength when deflected.

5 Claims, 4 Drawing Sheets

X-Y TABLE DEVICE IN AUTOMATIC SEWING MACHINE

BACKGROUND OF THE INVENTION

This invention relates to an X-Y table device for use with a sewing machine which performs the embroidering of a variety of patterns on cloths.

An X-Y table device of this type is used to embroider a variety of patterns on cloths with a sewing machine as shown in FIGS. 6 and 7. In the figures, reference numeral 1 designates a sewing machine head in which a sewing mechanism including a sewing needle and its drive system is built; 2, a bed supporting the sewing machine head and incorporating an X-Y table device, the head and the bed being arranged on a table stand 3; and 9, a cloth retainer arranged below the sewing needle of the head 1. The cloth retainer 9 is coupled to a retaining arm 8 at one end. At the other end of the retaining arm 8 a supporting piece 8*a* extended therefrom is secured to the movable stand 10*a* of the X-Y table 10 provided in the bed 2 with screws. A shaft support 12 is fixedly secured to the end face of the support piece 8*a* with screws. Further in FIG. 7, reference numeral 13 designates a bearing; 14, a slide shaft; and 15, a drive shaft. In response to control signals from an electronic control board 7 (FIG. 6), electric motors 11*a* and 11*b* such as stepping motors or servo motors drive the X-Y table 10 two-dimensionally.

The operation of the sewing machine thus constructed will be described. First, a start switch 6 is turned on and then a start switch 5 for starting a sewing operation is turned on. As a result, in synchronization with the operation of the sewing machine head 1, the retaining arm 8, the supporting piece 8*a*, the shaft support 12, the slide shaft 14, the bearing 13 and the drive shaft 15 are moved over the bed by the X-Y table 10 according to a desired pattern stored in a memory medium 4 which has stored patterns programmed in advance, so that the desired pattern is embroidered on the cloth held by the cloth retainer 9 with the aid of the retaining arm 8.

In the sewing machine with the conventional X-Y table device, the cloth retaining mechanism is provided on the side of the retaining arm 8. Therefore, in the case where, in a sewing operation, its accuracy and speed are essential factors, it is necessary to reduce the weight and deflection of the members between the cloth retainer 9 and the motors 11*a* and 11*b* as much as possible. In a large area sewing machine which is so designed that the cloth retainer is movable over a wide range, its components are large in weight accordingly, and the movement of the cloth retainer is greatly resisted. Accordingly, with the large area sewing machine, in a continuous sewing operation and particularly in an intermittent sewing operation, the retaining arm 8, the slide shaft 14, the bearing 12, the X-Y table 10, and the drive shaft 15 may be swung horizontally, or they may be deflected, so that it becomes difficult to achieve the sewing operation at high speed with high accuracy.

SUMMARY OF THE INVENTION

Accordingly, an object of this invention is to eliminate the above-described difficulties accompanying a conventional X-Y table device in an automatic sewing machine.

More specifically, an object of the invention is to provide an X-Y table device for an automatic sewing machine in which, even in the case where, as in the case of a large area sewing machine, the range of movement of the cloth retainer is large, and the components are large in weight accordingly, the sewing operation can be achieved at high speed with high accuracy.

The foregoing object and other objects of the invention have been achieved by the provision of an X-Y table device for automatic sewing machine in which a cloth retainer is moved according to a pattern stored in a memory medium, to embroider the pattern, which comprises: a moving body provided on an X-Y table, the moving body, being moved by drive means two-dimensionally; a support secured to the moving body, to transmit the two-dimensional movement to the cloth retainer; a guide rail having a plurality of rail surfaces which, together with the support, forms one unit high in rigidity, the guide rail being extended to allow the moving body to move in one direction; and guide block means engaged movably with the plurality of rail surfaces of the guide rail, to guide the guide rail in one direction, and coupled to another drive means to transmit the movement, in the other direction, of the moving body to the guide rail.

The nature, principle and utility of the invention will become more apparent from the following detailed description and the appended claims when read in conjunction with the accompanying drawings, in which like parts are designated by like reference numerals or characters.

DETAILED DESCRIPTION OF THE INVENTION

One example of an X-Y table device for an automatic sewing machine according to this invention will be described with reference to the accompanying drawings.

Figure 1:
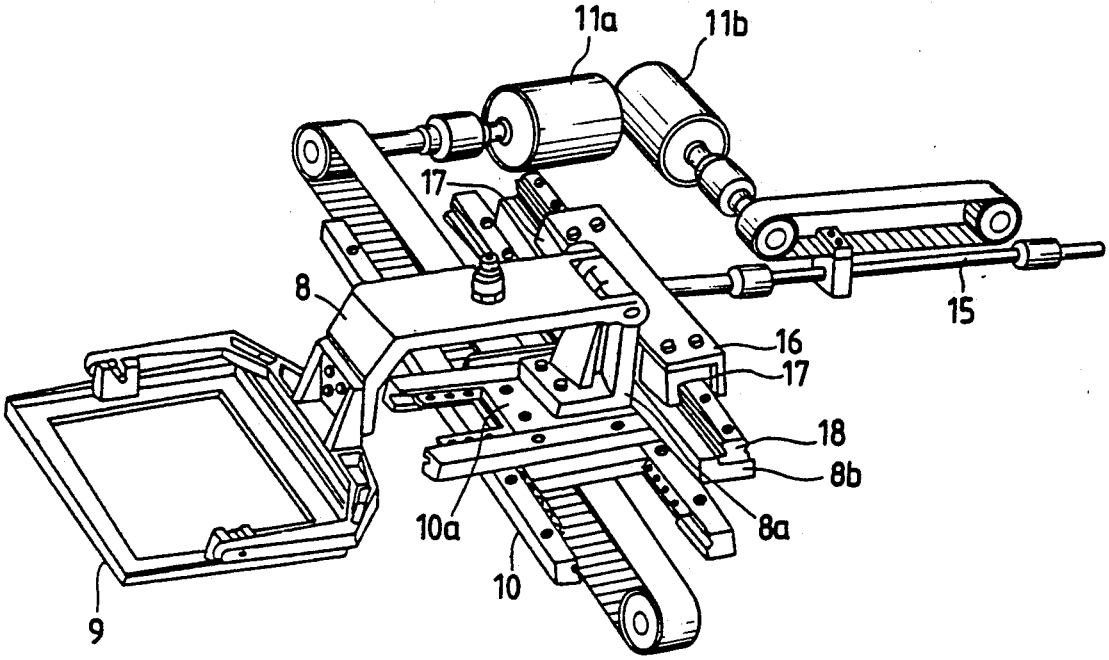
FIG. 1 is a perspective view showing one example of an X-Y table device in an automatic sewing machine according to this invention.
Figure 3:
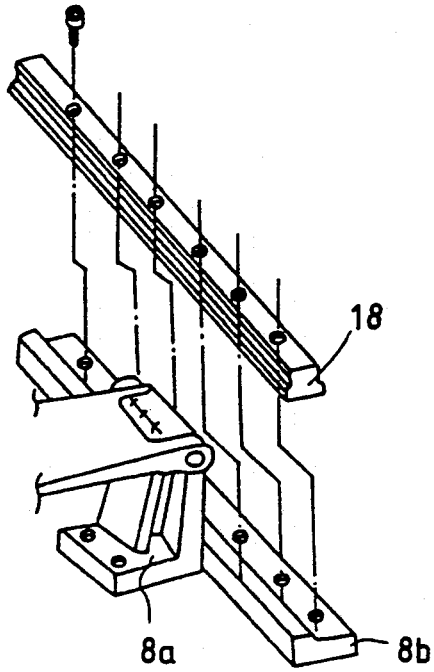
FIG. 3 is a perspective view showing supporting pieces and a guide rail in the X-Y table device of the invention.
Figure 2:
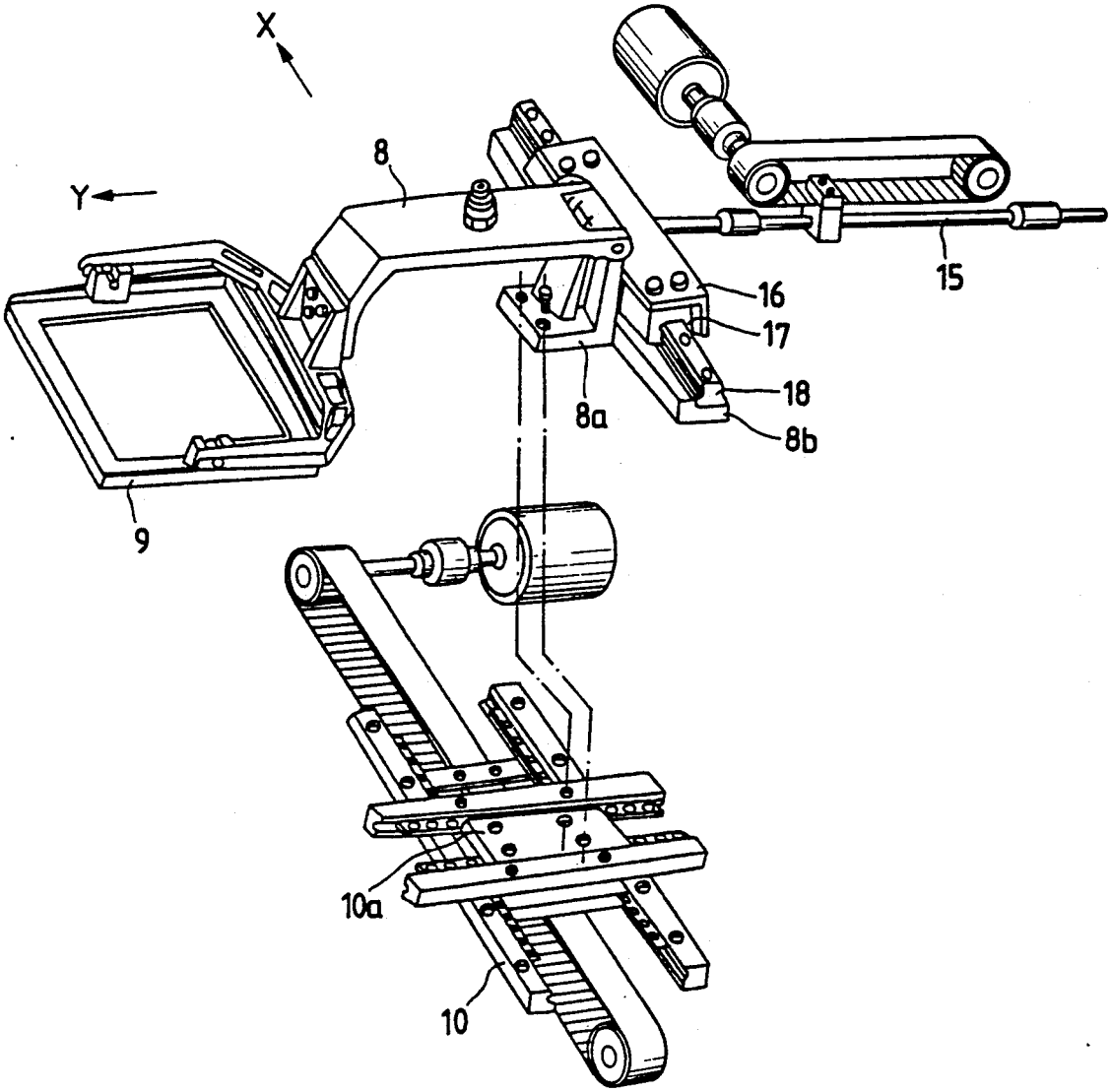
FIG. 2 is an exploded perspective view showing the X-Y table device according to the invention.
Figure 6:
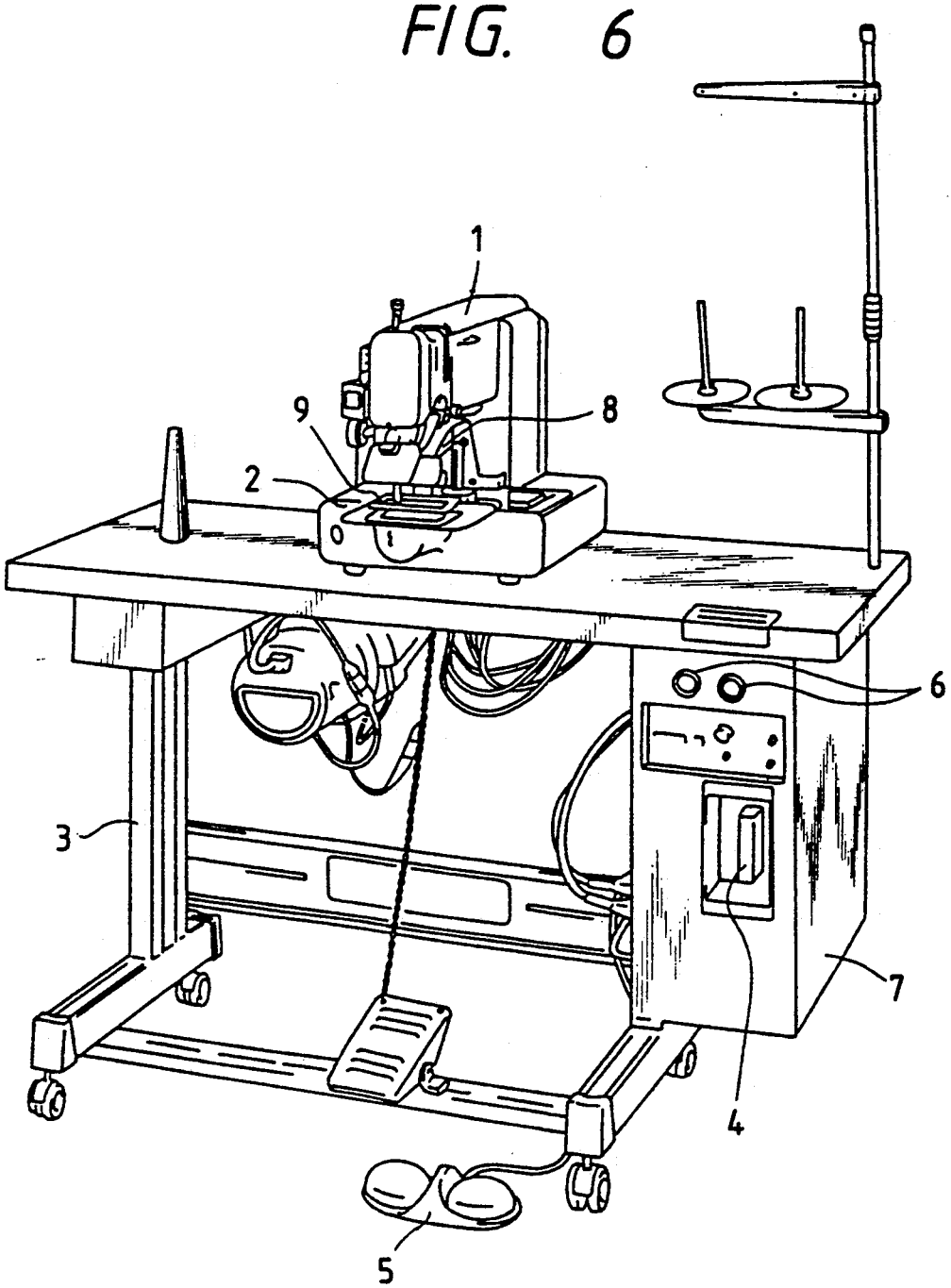
FIG. 6 is a perspective view showing the external appearance of a conventional automatic sewing machine.

In FIG. 6, reference numeral 1 designates a sewing machine head incorporating a sewing mechanism including a sewing needle, its drive means, etc ; 2, a bed supporting the sewing machine head 1 and incorporating an X-Y table device, the head 1 and the bed 1 being provided on a table stand 3; and 9, a cloth retainer arranged below the sewing needle. The cloth retainer 9 is coupled to a retaining arm 8 at one end. At the other end of the retaining arm 8, as shown in FIG. 1, 2 and 3, its supporting pieces 8*a* and 8*b* are secured to the movable stand 10*a* of an X–Y table 10 provided in the bed with screws. A guide rail 18 and two guide blocks 17 are provided on the supporting piece 8*b*. A shaft support 16 is secured to the guide blocks with screws, and a drive shaft 15 is secured to the shaft support 16 with screws. In response to control signals from an electronic control board 7, the X–Y table 10 is moved by electric motors 11*a* and 11*b* such as stepping motors or servo motors in a horizontal plane, or X- and Y-directions.

The sewing machine shown in FIGS. 1 and 2 operate as follows: when a power switch (FIG. 6) is turned on and the start switch for starting a sewing operation is turned on, in synchronization with the operation of the sewing machine head 1, the retaining arm 8, the supporting pieces 8*a* and 8*b*, the guide blocks 17, the guide rail 18, the shaft support 16 and the drive shaft 15 are moved over the bed by the X–Y table 10 according to a desired pattern stored in a memory medium 4 which has stored pattern data programmed in advance, as a result of which the desired pattern is embroider on the cloth held through the cloth retainer by the retaining arm 8.

As is apparent from the above description, the X–Y table 10, the retaining arm 8 and the cloth retainer 9 can be assembled with high accuracy by the provision of the supporting pieces and the guide rail which are high in rigidity. Therefore, the cloth retainer can be moved with low resistance.

Figure 4:
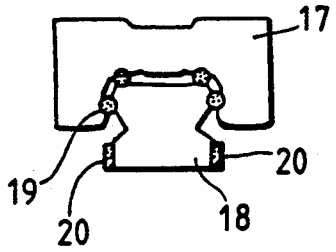
FIG. 4 is a sectional view showing the engagement of the guide rail and a guide block in the X-Y table device of the invention.

The guide rail 18 is engaged with the guide blocks 17 as shown in FIG. 4. In FIG. 4, reference numeral 19 designates balls which are in contact with the rail surfaces; and 20, the sides of the guide rail 18. That is, the guide rail 18 is engaged through the balls 19 with the guide blocks 17, so that the guide rail 18 and the guide blocks 17 are smoothly movable relative to each other.

The above-described X–Y table device has two guide blocks 17; however, it should be noted that the invention is not limited thereto or thereby. In other words, the number of guide blocks is not always limited to two, if it can reduce the weight of the device and allows the easy movement of the device.

Figure 5:
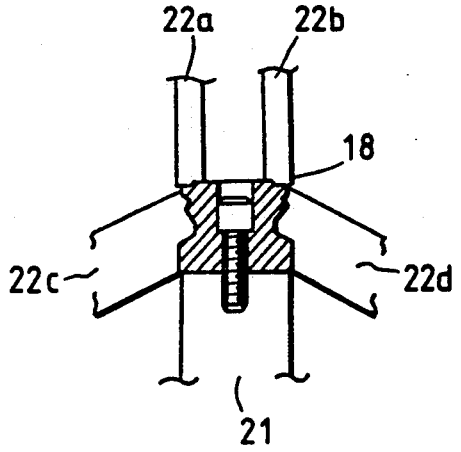
FIG. 5 is an explanatory diagram showing a method of forming the guide rail.
Figure 7:
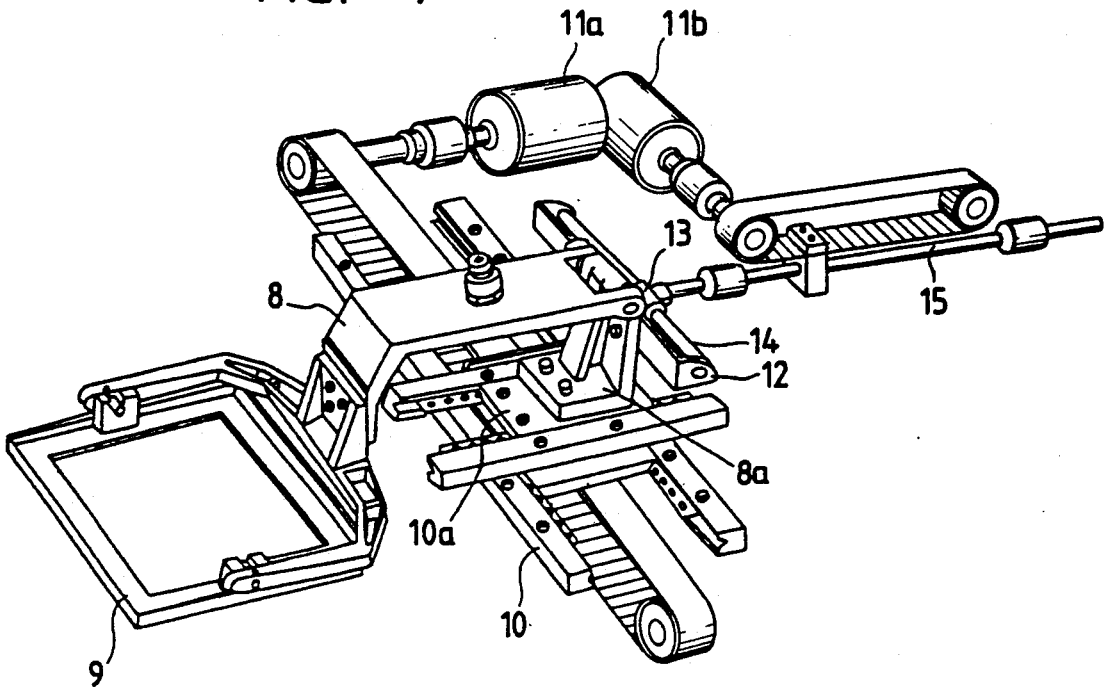
FIG. 7 is a perspective view showing a conventional X-Y table device in the automatic sewing machine.

The guide rail 18 is machined by using a jig 21 and grind-stones 22*a* through 22*d* as shown in FIG. 5. That is, the guide rail 18 is formed by a one-pass grinding method. With the guide rail 18 fixed to the jig 21, four rail surfaces of the guide rail, with which the balls 19 are in contact, and two opposite sides of the guide rail are simultaneously ground.

As was described above, the guide rail 18 tightened to the jig is grounded. Therefore, if the guide rail 18 is tightened with the same torque when installed on the device body, then it can be installed with the same accuracy. In this case, it can be readily installed on the guide rail fixing surface with screws (with the same torque), with the result that the number of assembling steps can be greatly reduced, and the errors in the degree of parallelization and in level can be absorbed with ease. Hence, the device can be readily moved with high accuracy.

Furthermore, a plurality of surfaces (six surfaces) of the guide rail are ground simultaneously, and therefore they are high in flatness, and the guide rail can be provided at low manufacturing cost.

Moreover, for the same reason, even if the device is made large both in size and in weight, it can be moved stably.

Since the supporting pieces and the guide rail are high in rigidity, the retaining arm etc. will not be substantially bent nor twisted, with the result that the desired pattern can be embroidered finely.

It goes without saying that, since the opposite sides of the guide rail are ground together with the rail surfaces thereof, the guide rail can be accurately positioned on the supporting piece 8.

EFFECTS OF THE INVENTION

As was described above, in the X–Y table device according to the invention, the guide blocks and the guide rail are provided on the supporting piece of the retaining arm used for a sewing operation, whereby the retaining arm is supported stably and accordingly operated stably. As a result, the horizontal vibration of the retaining arm etc. is prevented. For the same reason, the X–Y table device is excellent in mechanical strength when deflected, and its supporting members are also high in mechanical strength.

The guide rail is machined with the jig tightened thereto.

Therefore, if it is tightened with the same torque when installed, it can be installed with the same accuracy. Thus, the X–Y table device of the invention can be driven with high accuracy.

What is claimed is:

1. An X-Y table device in an automatic sewing machine in which a cloth retainer is moved according to a pattern stored in a memory medium, to embroider the pattern, which comprises:

a moving body provided on an X-Y table, said moving body being moved by first and second drive means two-dimensionally in respective first and second directions;

a support secured to said moving body, to transmit the two-dimensional movement to said cloth retainer;

a guide rail having a plurality of rail surfaces which, together with said support, forms one unit high in rigidity, said guide rail being extended to guide movement of said moving body in said first direction; and guide block means engaged movably with said plurality of rail surfaces of said guide rail, to guide said guide rail in said first direction, and coupled to said second drive means to move said guide rail in said second direction, whereby said moving body also is moved in said second direction.

2. An X–Y table device as claimed in claim 1, in which said guide block means comprises a plurality of guide blocks.

3. An X–Y table device as claimed in claim 1, in which said guide block means are in contact with the rail surfaces of said guide rail through balls.

4. An X–Y table device as claimed in claim 1, in which said guide rail has rail surfaces which are formed by simultaneously grinding said guide rail with a jig secured thereto.

5. An X–Y table device as claimed in claim 4, in which said guide rail is tightened to said jig under a first condition and said guide rail is secured to said support under said same first condition.

* * * * *